United States Patent [19]

Sanders

[11] 4,166,482

[45] Sep. 4, 1979

[54] LUBRICATED VALVE BAG AND METHOD OF LUBRICATING VALVE SPOUT

[75] Inventor: James R. Sanders, Savannah, Ga.

[73] Assignee: Union Camp Corporation, Wayne, N.J.

[21] Appl. No.: 916,468

[22] Filed: Jun. 19, 1978

[51] Int. Cl.[2] ..... B65B 3/00; B67C 3/30

[52] U.S. Cl. ..... 141/1; 141/68; 141/392; 184/1 R; 229/62.5

[58] Field of Search ..... 184/1; 141/1, 67, 68, 141/114, 392, 313, 314, 315, 316, 317, 329, 10; 150/9; 46/90; 229/62.5, 62, 485 B; 128/DIG. 24, 272, 214 D

[56] References Cited

U.S. PATENT DOCUMENTS 3,118,474 1/1964 Eppolito ..... 141/68

*Primary Examiner*—Houston S. Bell

*Attorney, Agent, or Firm*—Kane, Dalsimer, Kane, Sullivan and Kurucz

[57] ABSTRACT

A valve bag with an opening in one corner adapted to receive a spout for filling the bag, the opening having an insert therein, which insert has a light coating of a lubricant on its inner surface, so that when the bag is slipped on the filling spout some of the lubricant will be transferred to the spout and lubricate the spout for the next bag to be slipped on the spout.

11 Claims, 13 Drawing Figures

LUBRICATED VALVE BAG AND METHOD OF LUBRICATING VALVE SPOUT

BACKGROUND OF THE INVENTION

1. Field of the Invention

The invention relates to valve bags which are closed by pasting or sewing at both ends except for a filling valve in one corner, and more particularly to a type of bag which will lubricate the filling spout when it is inserted in the valve opening and facilitate slipping on the spout successive bags to be filled.

2. Description of the Prior Art

The prior art does not disclose a bag having the same construction as the bag of the present invention and which serves to lubricate the filling spout each time a bag is slipped on the spout to provide a lubricant for successive bags placed on the spout.

It is well known to apply a lubricant to spouts for filling bags, but such lubricant wears off rapidly and must be replaced. For example U.S. Pat. No. 3,294,127 discloses lubrication with a soap solution.

Other prior art patents disclose sheaths or cases to lubricate the product placed therein, i.e. U.S. Pat. Nos. 1,240,880; 1,612,861; 1,888,289; and 2,469,763. U.S. Pat. No. 3,282,414 discloses a prophylactic with lubricant. Other patents and publications disclose the use of Teflon as a lubricant, i.e. U.S. Pat. No. 3,080,183; British Pat. No. 770,774; and the "Journal of Teflon—Nov. 1965".

SUMMARY OF THE INVENTION

The invention covers a valve bag with an opening in one corner adapted to receive a spout for filling the bag which comprises an insert placed in the valve opening; and a light coating of a lubricant applied to the inner surface of the insert, which lubricant, when the bag is slipped on the filling spout, will be transferred to the spout and lubricate the spout for the next bag to be slipped on the spout.

DESCRIPTION OF THE PREFERRED EMBODIMENT

Paper bags having valved filling openings are in common use for packaging bulk material, such as chemicals, cement, fertilizer, grain, feed, flour and the like. Such bags are made of a tough and strong paper or other fibrous or plastic material, and usually have walls comprising multi-ply layers of paper to increase their strength. Such bags are filled by inserting a spout through the filling opening and blowing the bulk material therein. When the bag has been filled, the spout is withdrawn and the valve is automatically closed by the pressure of the material in the bag against the valve. Various forms of inserts have been placed in the valve opening to facilitate opening the valve for insertion on the filling spout and to seal or provide a tighter closure after the bag has been filled. Such inserts can take various forms such as a single sheet seat, a tubular insert, or a tubular tuck-in sleeve. The inserts may be made entirely of paper or a combination of paper and plastic film. The sleeves can be formed of tubular material or a single sheet folded to form a tube. The inserts are secured in the valve corner by adhesive. In order to provide a bag having the required strength to resist rupture during handling, many bags are being made with multi-ply walls. Such a bag comprises a plurality of separate sheets positioned one inside the other and may have as many as six plies or layers of paper or a combination of paper and plastic. The bags described in this paragraph and their formation are conventional and well known and do not form a feature of the present invention.

The problem with valve bags is that the operator must open the valve and slip it on the filling spout by hand. The valve bag hangs on the spout with the top surface of the spout in direct contact with the inner surface of the top of the valve. Heretofore, it has been found that such operation can be speeded up by applying a slick tape, such as Teflon, or a lubricant, such as soap or wax, to the filling spout. However, such tape or lubricant wears off and must be continuously replaced. The present invention overcomes this problem by providing a valve bag which transfers lubricant to the valve spout so that the spout is always lubricated. It is adaptable for every type of valve bag having an insert, i.e. the pasted valve bags shown in FIGS. 1 and 2 and the sewn valve bags shown in FIGS. 3 and 4.

Figure 1:
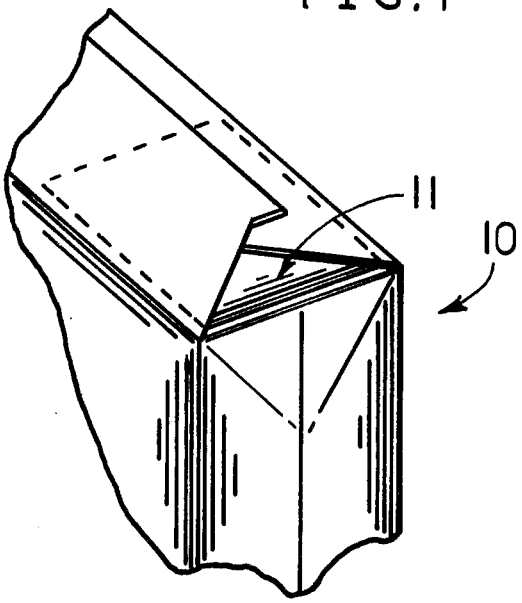
FIG. 1 is a perspective view of the valve corner of a pasted valve bag with a tubular insert in the valve.
Figure 6B:
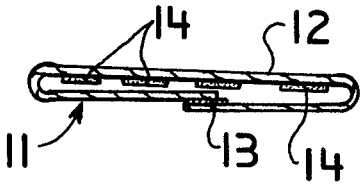
FIG. 6B is a sectional end view of the tubular insert formed from the sheet of FIG. 6A.

The pasted valve bag 10 shown in FIG. 1, embodies a tubular insert 11. Such insert can be made of a single sheet 12 (FIG. 6A) which is folded over and secured with adhesive 13 along the edge to form a tube (FIG. 6B). Prior to folding and inserting in the bag the sheet is coated with a thin layer of a lubricating material 14. Such material can be applied as a solid sheet or in multiple stripes. The material can be tinted to make the application visible in the bag. Although such coating can be applied to the entire sheet 12, it has been found that the same result can be obtained by only coating one half of the sheet. Such coated half is applied so that it is in the top of the tubular insert. When the bag ends are flattened prior to use a sufficient amount of the lubricating material is transferred to the bottom half of the insert, thereby lubricating the full circumference of the valve mouth.

Figure 2:
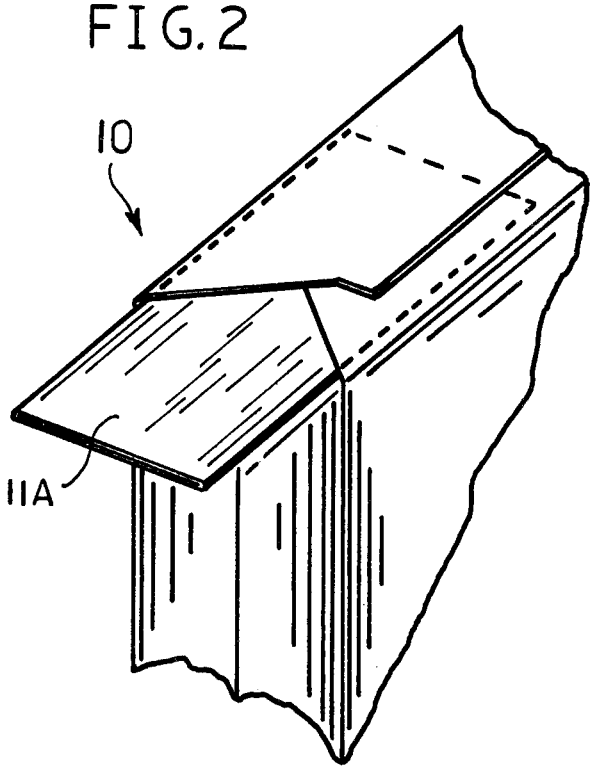
FIG. 2 is a perspective view of the valve corner of a pasted valve bag with a tuck-in sleeve insert in the valve.

The tuck-in-sleeve of the bag in FIG. 2 is made in the same way as the tubular insert of FIG. 1, except that the sheet for the tuck-in-sleeve is longer (herein designated as 11A).

Figure 5C:
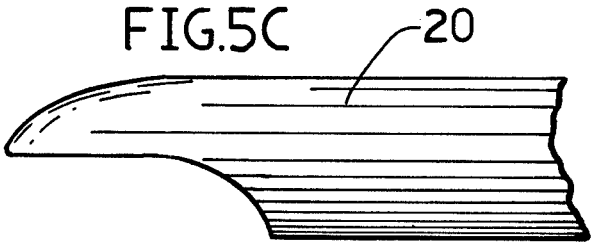
FIG. 5C is a side view showing the form of the filling spout.
Figure 6A:
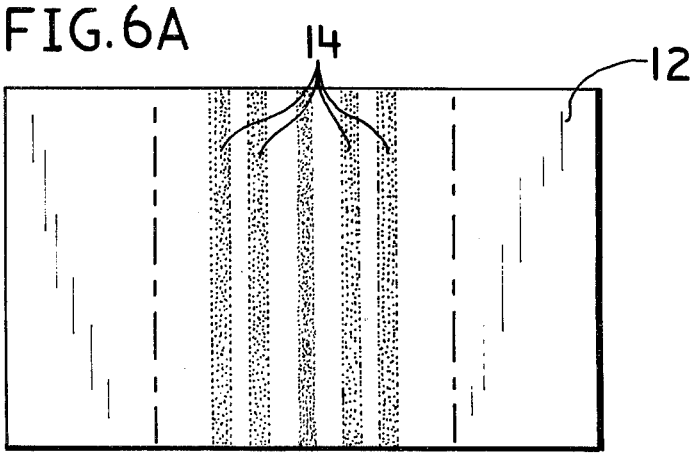
FIG. 6A is a top view of a single sheet to which lubricant has been applied, which sheet can be folded over to form a tube to serve as an insert for a pasted valve bag.
Figure 6C:
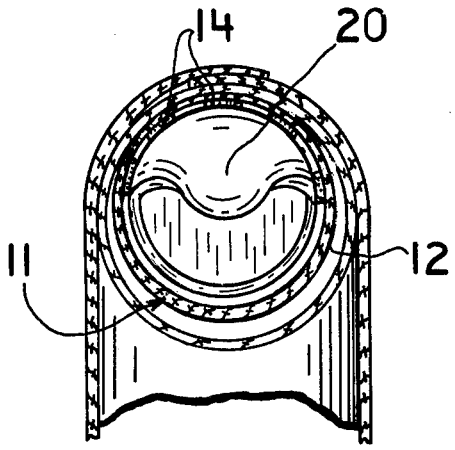
FIG. 6C is a sectional end view looking into the valve opening of a pasted valve bag and showing the tubular insert of FIG. 6B.

FIG. 6C illustrates the form of the insert for the pasted valve bag when valve is opened and the spout 20 (FIG. 5C) is inserted in the valve. It will be seen that the bag is hanging from the top of the spout with the top surface of the spout in contact with the lubricating material positioned in the top of the valve.

Figure 7B:
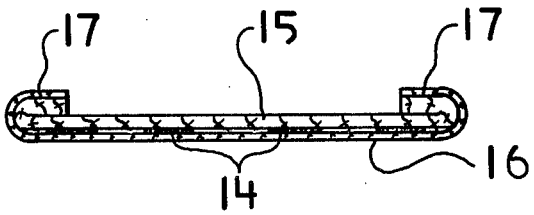
FIG. 7B is an end view of the sheet of FIG. 7A combined with another sheet to form a tube.
Figure 7A:
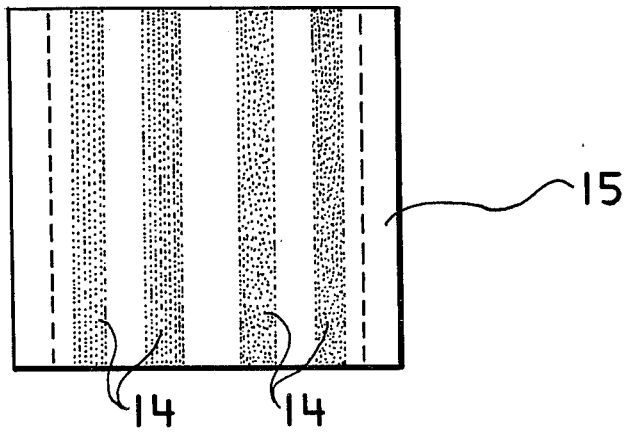
FIG. 7A is a top view of a single sheet to which lubricant has been applied, which sheet can be used alone as a valve seat or in combination with another sheet secured along the outer edges to form a tube to serve as an insert for a pasted valve bag.

The sheet 15 of FIG. 7A can be used as a seat for insertion in the top of the valve corner of a pasted valve bag or can be used as one half of a sleeve for a pasted valve bag. When it is to be used as part of a sleeve, another sheet 16, for example, plastic film, can be used as the bottom sheet by securing the two together with adhesive 17 along the outside edges (FIG. 7B). The sheet 15 is coated with lubricant 14 in the same manner as the sheet 12 of FIG. 6A, such lubricant being positioned so that it will be in the top of the valve.

Figure 3:
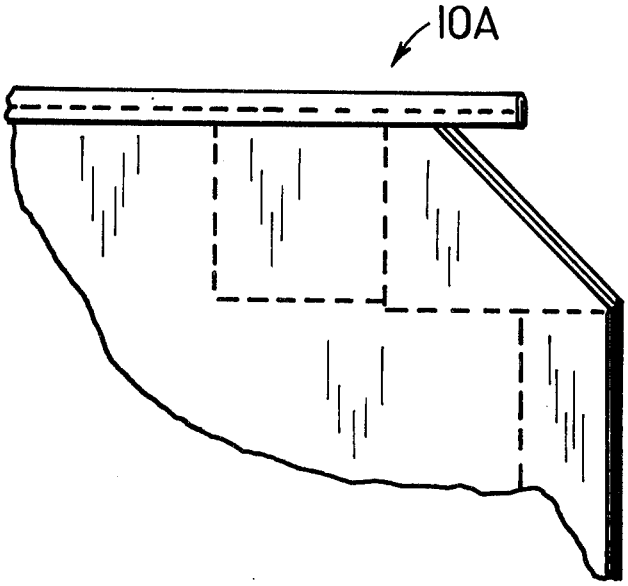
FIG. 3 is a side view of the valve corner of a sewn valve bag with an insert in the valve.
Figure 4:
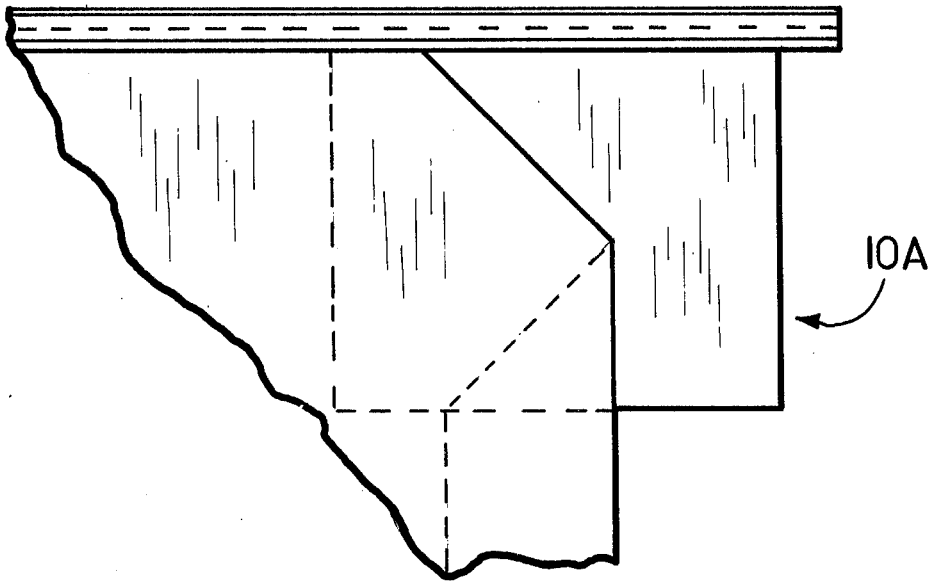
FIG. 4 is a side view of the valve corner of a sewn valve bag with a tuck-in sleeve insert in the valve.
Figure 5A:
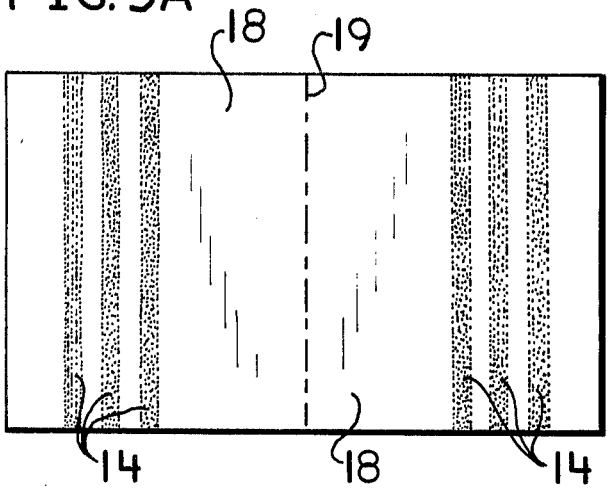
FIG. 5A is a top view of a single sheet to which lubricant has been applied, which sheet can be folded over to form a tube to serve as an insert for a sewn valve bag.
Figure 5B:
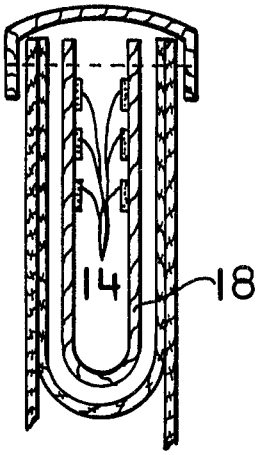
FIG. 5B is a sectional end view, with the parts separated for illustration, looking into the valve opening of a sewn valve bag and showing the sheet of FIG. 5A.
Figure 5D:
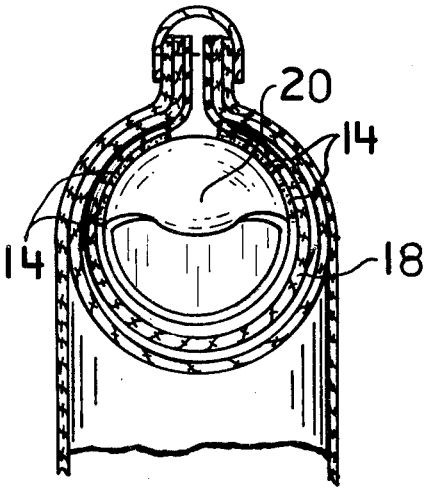
FIG. 5D is a view similar to that of FIG. 5B showing the bag positioned on the filling spout with the valve open.

For the sewn valve bags 10A shown in FIGS. 3 and 4, a sheet 18, similar to the sheet 12 of FIG. 6A, is used (FIG. 5A). However, such sheet 18 is folded vertically along the line 19 and the lubricating material 14 is applied along the outer ends so that when the sheet is folded, as shown in FIG. 5B, the lubricating material will end up at the top of the valve (FIG. 5D). This will be apparent from FIG. 5D showing the open valve with the spout inserted therein. It is possible to coat one half of the sheet for the sewn valve bag which half will constitute one side of the insert. In flattened condition the lubricant on one side will be transferred to the other side as described above.

It has been found that various materials can be used for the coating, i.e. mineral oil, silicone oil, paraffin, and emulsions of mineral oil, silicone oil, paraffin and polyethylene waxes. When the upper inner surface of the valve is paper or other fibrous porous material the valve can be lubricated by using straight oils, but this is expensive. A preferred formula would consist of the following:

2% to 100% silicone oil emulsion of 30% concentration

98% to 0% of an 8% starch solution

The starch is essential to prevent the oil from being absorbed by the sheet and holding the oil on the surface so that it will lubricate the packer spout when the valve bag is inserted over the spout. A typical formula is:

9 lbs of Dow Corning DB-31 silicone antifoam 9 lbs of water

4½ lbs of 8% Pearl starch solution 30 militers of 5% Victoria Green Dye

For a plastic coated paper or plastic film surface the above formula without the starch would be used. It will be apparent that different formulations can be used depending on the nature of the surface to which the lubricant is to be applied. It is essential that a thin coating of the lubricant remain on the surface so that some can be transferred to the spout when the bag is inserted over the spout.

The lubrication principle of the present invention is similar to that of a 2 cycle gas oil mixture engine. Instead of lubricating the pistons on every stroke the coated valve lubricates the filling spout every time a bag is inserted.

The pre-lubricated valve improves the performance of the automated filling equipment by insuring smooth entry of the spout even though the bags are not directly aligned. The nuisance effect of slight sticking in the valve that affects automatic bag hanging should all but disappear with the prelubricated valve. The cost of the lubricating material, which is minimal, will be the only added production cost. Machine run or set-up will not be affected.

The following advantages resulted from the present invention:

1. The bags slipped on the spout much easier.
2. The bags departed from the spout much easier.
3. Fatigue on the operators over an eight hour day will be less.
4. Improved production of approximately 10 percent was achieved.

Those skilled in the art will appreciate that many variations of the above described embodiment of the invention may be made without departing from the spirit and the scope of the invention.

What is claimed:

1. In a bag having a valve opening at one corner to receive a valve spout for filling the bag improvement comprising a valve insert secured within the said opening to facilitate insertion of the spout in the opening; and a thin coating of lubricant applied to the inner surface of the valve insert;

whereby when the spout is inserted into the said bag, some of the lubricant will be transferred to the outer surface of the valve spout and facilitate slipping succeeding bags onto the spout.

2. The bag of claim 1 in which the lubricant is positioned on the valve insert to contact the top surface of the spout when the bag is hung on the spout.

3. The bag of claim 1 in which the insert is a single sheet secured across the top of the valve opening.

4. The bag of claim 1 in which the insert is a tube secured within the valve opening with approximately the first half of the tube superimposed over the second half of the tube.

5. The bag of claim 1 in which the lubricant is applied to the inner surface of the valve insert in multiple spaced stripes.

6. The bag of claim 4 in which the lubricant is applied to approximately one of the said halves of the tube whereby when the bag end containing the tube insert is in flattened condition prior to filling a portion of the lubricant applied to one half will be transferred to the other half so that virtually the full circumference of the tube insert will be lubricated.

7. The method of lubricating the valve spout used for filling valve bags by inserting such spout into a valve opening having a valve insert secured within the said opening at one corner of each said bag comprising applying a thin coating of a lubricant to the inner surface of the valve insert of a first valve bag;

inserting the valve spout into the valve opening of the said first valve bag to bring the spout into contact with the lubricant on the valve insert;

whereby some of the lubricant will be transferred to the outer surface of the valve spout and facilitate slipping succeeding bags onto the spout.

8. The method of claim 7 wherein the coating of the lubricant is applied to the valve insert in a substantially continuous layer.

9. The method of claim 7 wherein the coating of the lubricant is applied to the valve insert in the form of multiple spaced stripes.

10. The method of claim 7 wherein the lubricant applied to the valve insert is positioned to contact the top surface of the spout when the bag is hung on the spout.

11. The method of claim 7 wherein the valve insert is in the form of a tube with approximately the first half of the tube superimposed over the second half of the tube and lubricant is applied to approximately one of the said halves of the tube.

* * * * *